US006402016B1

(12) United States Patent
Lee

(10) Patent No.: US 6,402,016 B1
(45) Date of Patent: Jun. 11, 2002

(54) UMBRELLA PACKAGE BOX

(75) Inventor: Harry Lee, Taipei (TW)

(73) Assignee: Joen-Shen Ma, Taipei (TW)

( * ) Notice: Subject to any disclaimer, the term of this patent is extended or adjusted under 35 U.S.C. 154(b) by 0 days.

(21) Appl. No.: 10/026,790

(22) Filed: Dec. 27, 2001

(51) Int. Cl.[7] ..... B65D 5/52; B65D 25/24

(52) U.S. Cl. ..... 229/103; 206/45.21; 229/240; 229/242; 248/146

(58) Field of Search ..... 229/103, 120.011, 229/240, 242; 206/45.21, 45.25, 45.26; 248/146, 152, 174, 346.01

(56) References Cited

U.S. PATENT DOCUMENTS 3,002,613 A * 10/1961 Merkel et al. ..... 229/240
3,190,532 A * 6/1965 Marsh ..... 229/103
3,465,948 A * 9/1969 Boyer ..... 248/152
3,853,259 A * 12/1974 Tupper ..... 229/103
4,380,289 A * 4/1983 Bigelow ..... 229/240
4,905,945 A * 3/1990 Peterson ..... 248/146
4,947,797 A * 8/1990 Lawrence, Jr. ..... 229/103
5,358,172 A * 10/1994 Hollander et al. ..... 229/103
5,375,702 A * 12/1994 Fiallo ..... 206/45.21
6,053,402 A * 4/2000 Thomas et al. ..... 229/120.011

* cited by examiner

*Primary Examiner*—Gary E. Elkins
(74) *Attorney, Agent, or Firm*—Rosenberg, Klein & Lee

(57) ABSTRACT

A parallelepiped package box is made of continuous boards and has front, rear, top, bottom and opposite side surfaces. Two parallel first tearing lines are formed on the box and extend along the front, rear and side surfaces to delimit a tear strip that are removable from the box to separate the box into a top cap and a bottom receptacle. An opening zone is delimited in the front surface of the cap by two spaced, first hinge lines extending in a vertical direction and two spaced, second tearing lines extending in a horizontal direction to connect between the first hinge lines. A third tearing line is also formed on the front surface of the cap, connecting between the second tearing lines and located between the first hinge lines. By tearing off the second and third tearing lines, two flaps are formed on the cap. The flaps are selectively folded along the hinge lines into the cap for forming an opening in the front surface of the cap. The bottom of the receptacle can be fit into the opening of the cap to be supported thereby and thus forming an article organizer for receiving and displaying articles therein.

8 Claims, 8 Drawing Sheets

UMBRELLA PACKAGE BOX

FIELD OF THE INVENTION

The present invention generally relates to the field of packages and more particularly to an umbrella package box that can be readily converted into a display bin.

BACKGROUND OF THE INVENTION

Umbrellas, especially large-sized umbrellas, are usually packed in a package box made of paper boards for transportation and storage. The package box of the umbrellas must be disposed of after it is opened for taking out the umbrella packed therein. This causes environmental problems.

On the other hand, those umbrellas that are taken out of the package box must be displayed to the consumers for sale purposes. Thus, an additional display stand is required. This increases costs of the retailers of umbrellas.

It is thus desirable to provide a device that is capable of packaging and displaying umbrellas or other articles to alleviate the above problems.

SUMMARY OF THE INVENTION

Accordingly, an object of the present invention is to provide a package box that is capable to receive articles, such as umbrellas, therein for storage and transportation purposes and can be readily converted into a display bin for displaying the articles to consumers.

Another object of the present invention is to provide a package box of consumer products that can be converted into a display bin for displaying the consumer products and thus saving of costs in making a display stand.

A further object of the present invention is to provide a package box that can be re-used for different purposes in order to reduce environmental protection problem.

To achieve the above objects, in accordance with the present invention, there is provided a package box made of continuous boards in the form of a parallelepiped container having front, rear, top, bottom and opposite side surfaces. Two parallel first tearing lines are formed on the box and extend along the front, rear and side surfaces to delimit a tear strip that are removable from the box to separate the box into a top cap and a bottom receptacle. An opening zone is delimited in the front surface of the cap by two spaced, first hinge lines extending in a vertical direction and two spaced, second tearing lines extending in a horizontal direction to connect between the first hinge lines. A third tearing line is also formed on the front surface of the cap, connecting between the second tearing lines and located between the first hinge lines. By tearing off the second and third tearing lines, two flaps are formed on the cap. The flaps are selectively folded along the hinge lines into the cap for forming an opening in the front surface of the cap. The bottom of the receptacle can be fit into the opening of the cap to be supported thereby and thus forming an article organizer for receiving and displaying articles therein.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
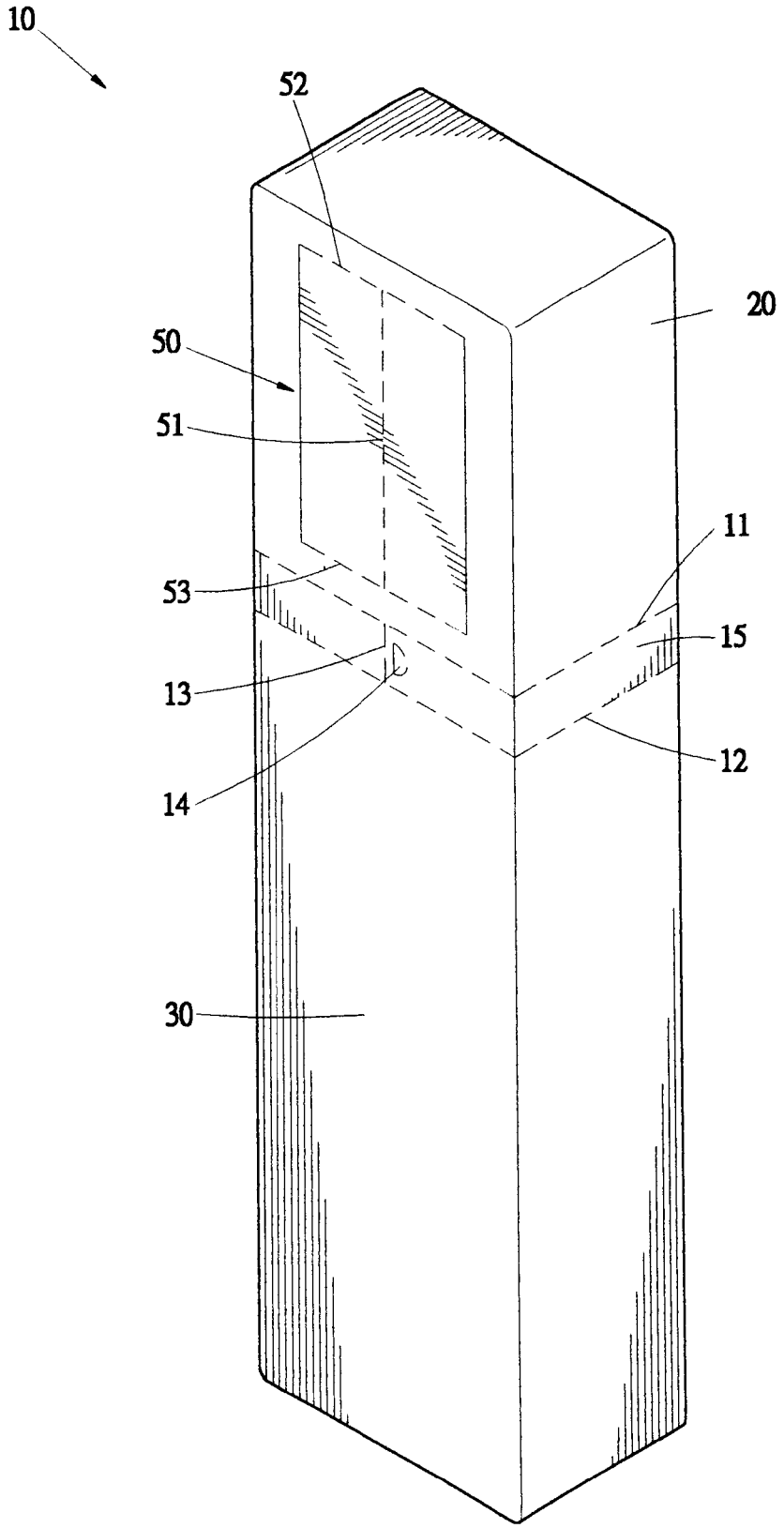
FIG. 1 is a perspective view of an umbrella package box constructed in accordance with a first embodiment of the present invention.
Figure 5:
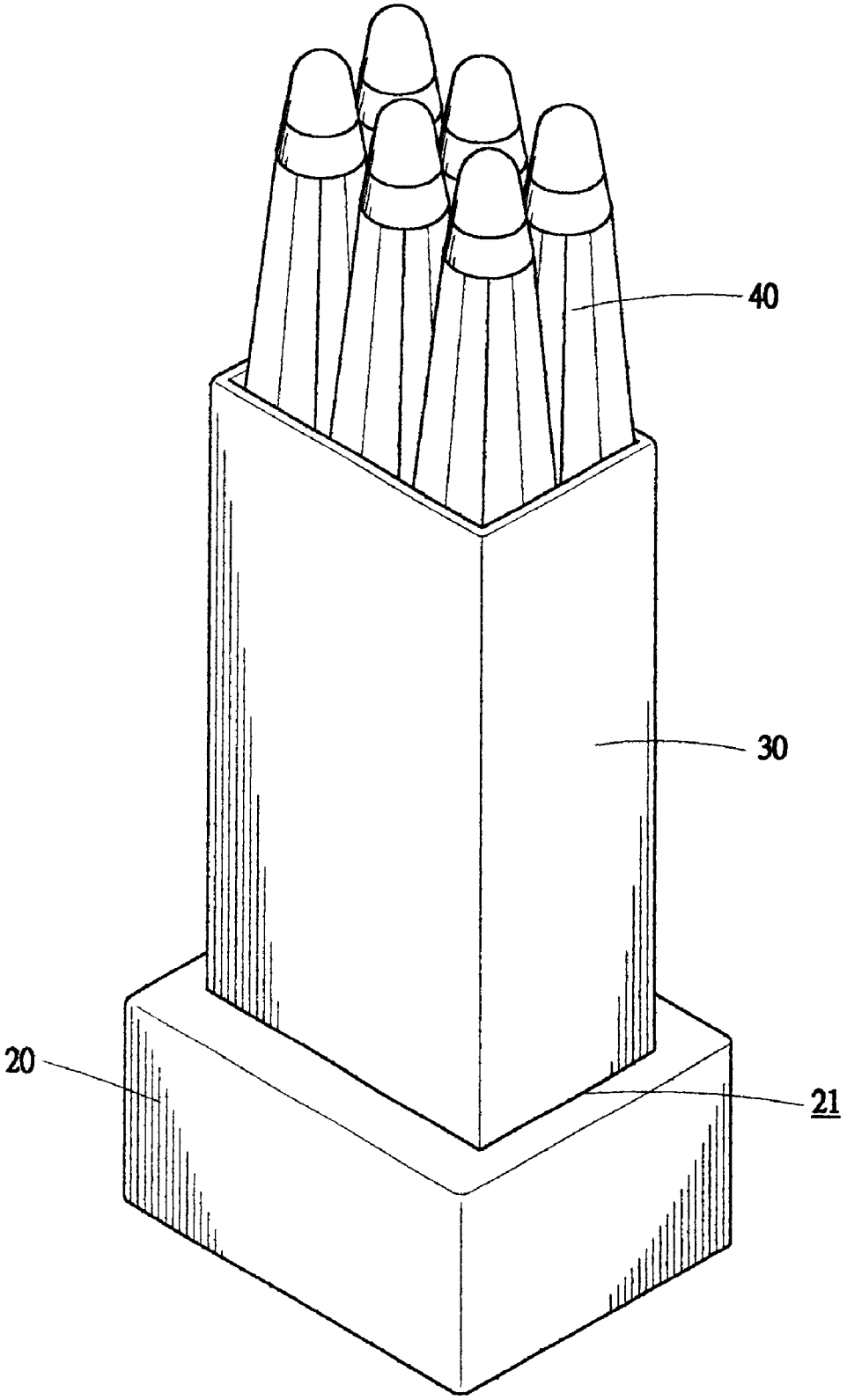
FIG. 5 is perspective view similar to FIG. 4 but showing umbrellas placed in the display bin for display and storage purposes.

With reference to the drawings and in particular to FIG. 1, wherein an umbrella package box constructed in accordance with a first embodiment of the present invention, generally designated with reference numeral 10, is shown, the package box 10 is formed as a parallelepiped container having top, bottom, front, rear and side surfaces delimiting an interior space for receiving and packaging at least one umbrella 40 (see FIG. 5). The box 10 is made of continuous boards, preferably paper board of sufficient strength.

The parallelepiped box 10 comprises a top cap 20 and a bottom receptacle 30 connected to each other by a tear strip 15. In the embodiment illustrated, the package box 10 is arranged as a standing slender container with the receptacle 30 placed on for example ground (not shown) and the cap 20 stacked over the receptacle 30. The standing slender container has an overall height measured between the top surface of the cap 20 and the bottom surface of the receptacle 30 in a vertical direction. The tear strip 15 is located a position around ⅓ the overall height from the top surface of the cap 20. Namely, neglecting the width (dimension in the vertical direction) of the tear strip 15, the cap 20 has a dimension in the vertical direction of about one half of that of the receptacle 30.

Figure 2:
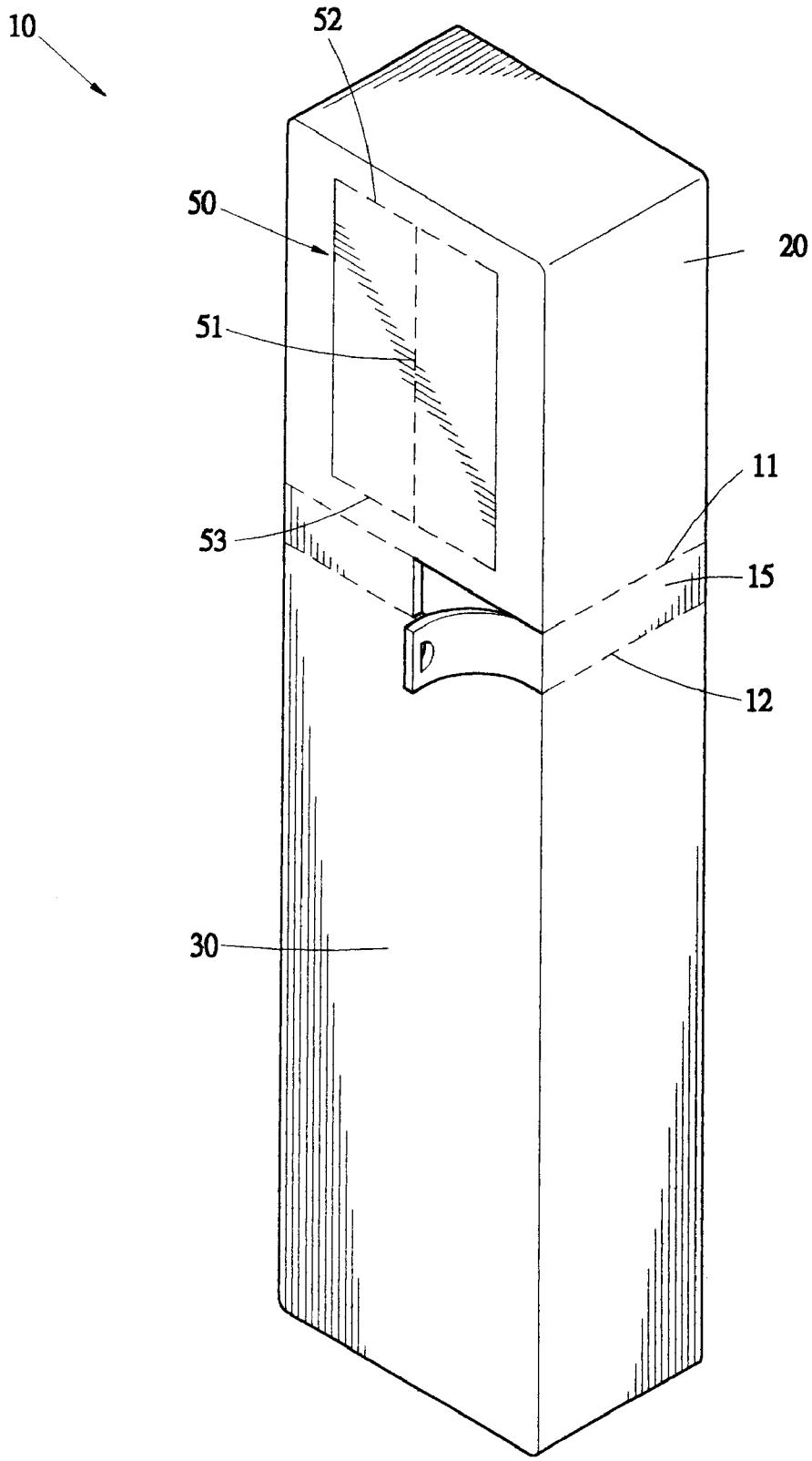
FIG. 2 is similar to FIG. 1 but showing a tear strip of the package box partially torn off.

The tear strip 15 is formed by making two parallel tearing lines 11, 12 extending in a horizontal direction (substantially perpendicular to the vertical direction) fully along the front, rear and side surfaces of the box. The tearing lines 11, 12 can be perforated lines or lines of any kind of weakened portion extending around the box that allow a user to easily separate the board materials above and below the tearing line as shown in FIG. 2. By tearing off the tear strip 15 along the tearing lines 11, 12, the cap 20 can be separated from the receptacle 30.

Figure 3:
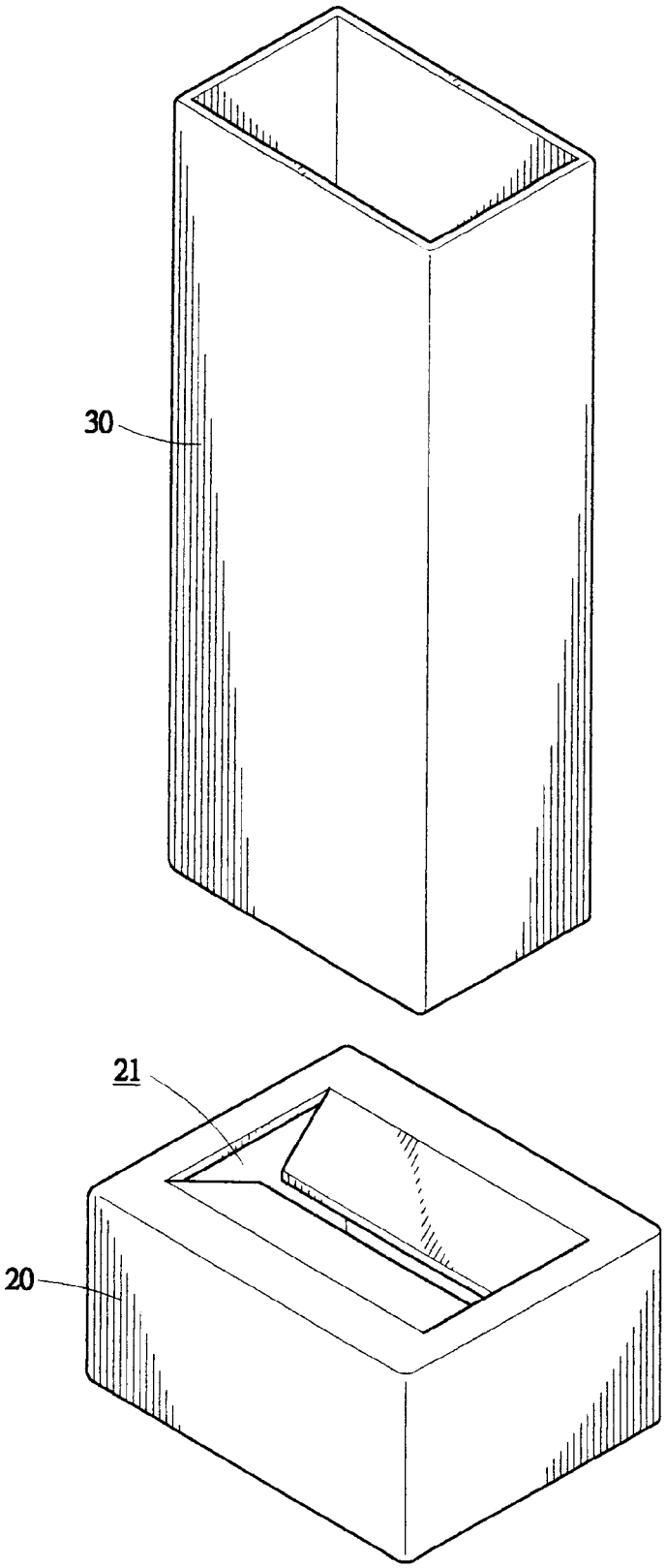
FIG. 3 is a perspective view showing a cap portion of the package box separated from a receptacle portion of the package box and positioned under the receptacle portion for serving as a support base of the receptacle portion in displaying or organizing umbrellas put in the receptacle portion.
Figure 4:
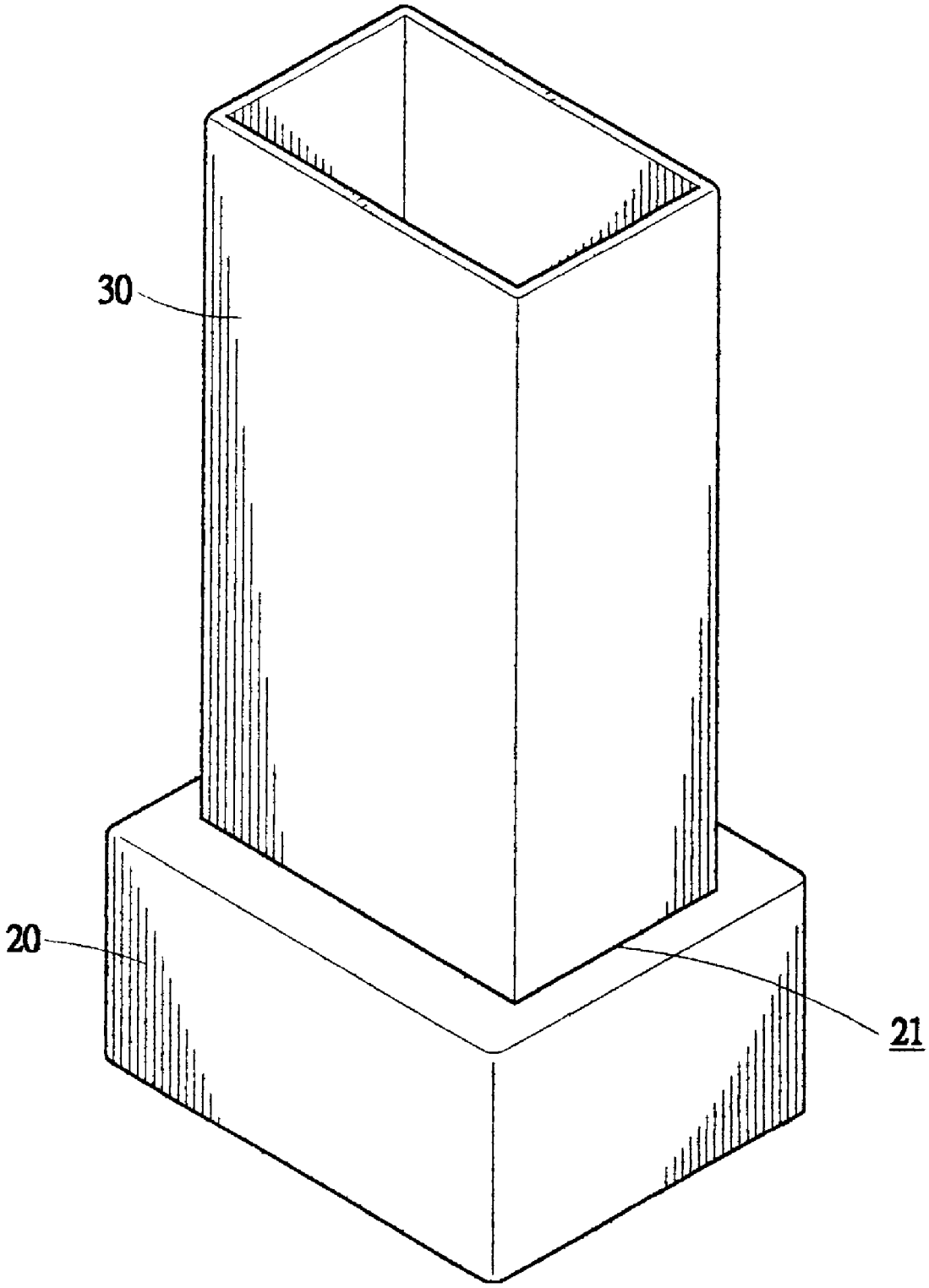
FIG. 4 is an assembled view of FIG. 3 showing an umbrella display bin formed by rearrangement the cap portion and receptacle portion the package box in different spatial relationship.

An opening zone 50 is delimited and formed by two hinge lines (not labeled) extending in the vertical direction on the front surface of the cap 20. Two tearing lines 52, 53 extending in the horizontal direction and connecting ends of the hinge lines are also formed in the front surface of the cap 20. An additional vertically-extending tearing line 51 substantially parallel to the hinge lines is formed on the front surface of the cap 20 preferably midway between the hinge lines. By tearing off the tearing lines 51, 52, 53, two flaps are formed on the front surface of the cap 20. By bending the flaps along the hinge lines into the cap 20, an opening 21 is formed in the front surface of the cap 20 as shown in FIG. 3. The bottom of the receptacle 30 may then be selectively fit into the opening 21 and firmly supported by the cap 20 as shown in FIG. 4, forming a display bin or an article organizer for receiving, storing and displaying articles, such as umbrellas 40 shown in FIG. 5. In this respect, the opening zone 50 is preferably sized precisely in accordance with the bottom surface of the receptacle 30 whereby the receptacle 30 can be snugly fit into the opening 21 of the cap 20.

Referring back to FIGS. 1 and 2, to facilitate user's tearing off the tear strip 15, a vertical tearing line 13 is formed on the front surface of the box 10 and connecting between the tearing lines 11, 12. In addition, a finger opening 14 is formed in the front surface of the box 10 adjacent the vertical tearing line 13 by forming corresponding closed tearing lines on the front surface of the box 10. A user may selectively remove the portion of the tear strip 15 that is closed by the closed tearing lines to form the finger opening 14. By inserting a finger into the finger opening 14 and pulling off an end of the tear strip 15 along the tearing lines 11, 12, the tear strip 15 can be readily removed to separate the cap 20 from the receptacle 30.

Figure 6:
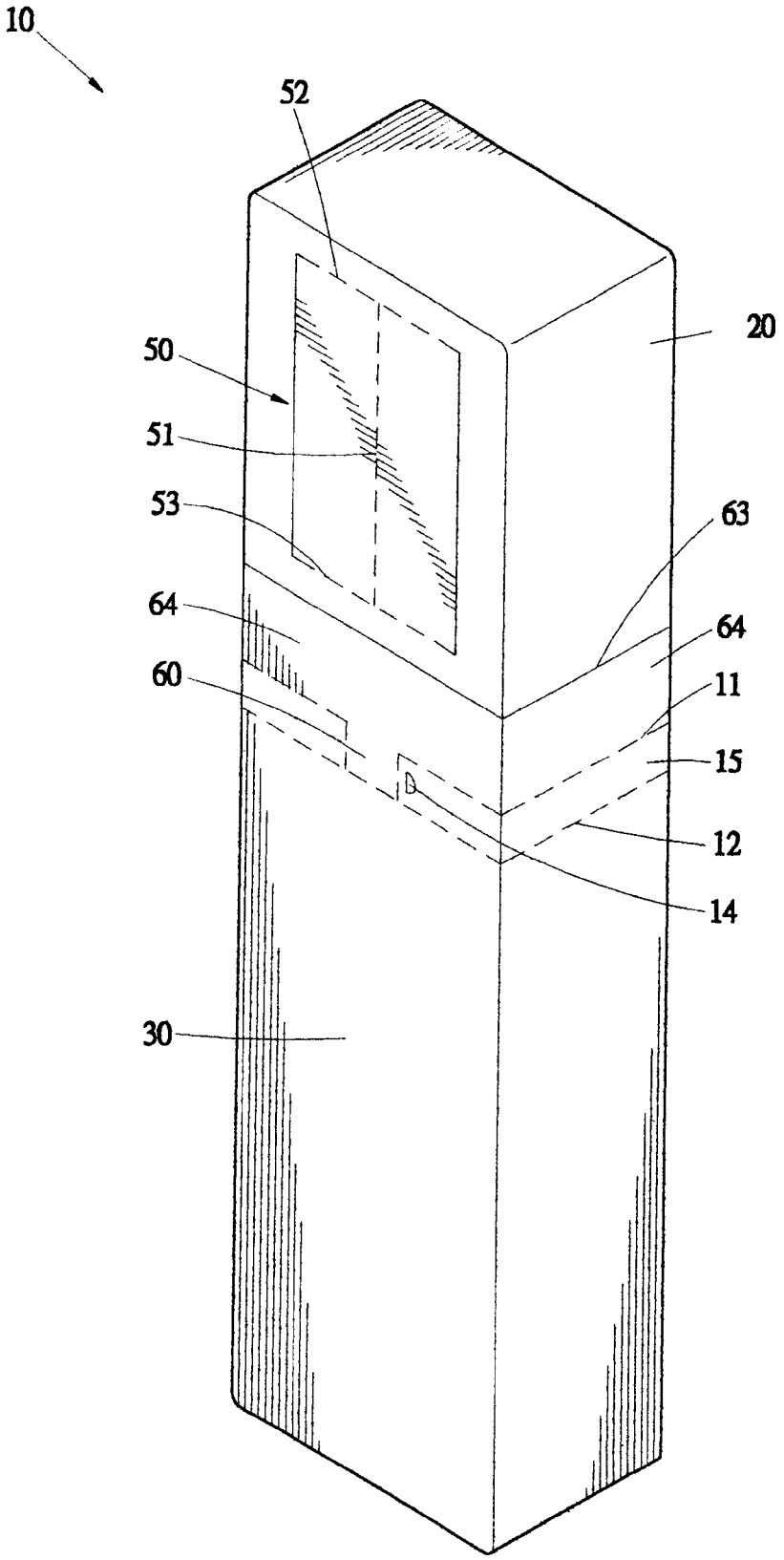
FIG. 6 is a perspective view of an umbrella package box constructed in accordance with a second embodiment of the present invention.

FIG. 6 shows a package box constructed in accordance with a second embodiment of the present invention, also designated with reference numeral 10 for simplicity. It is noted that the corresponding portions of the box 10 in the second embodiment are designated with the same reference numerals as the box of the first embodiment for purposes of simplifying the description. Thus, identical portion of the boxes 10 will not be described again.

Figure 7:
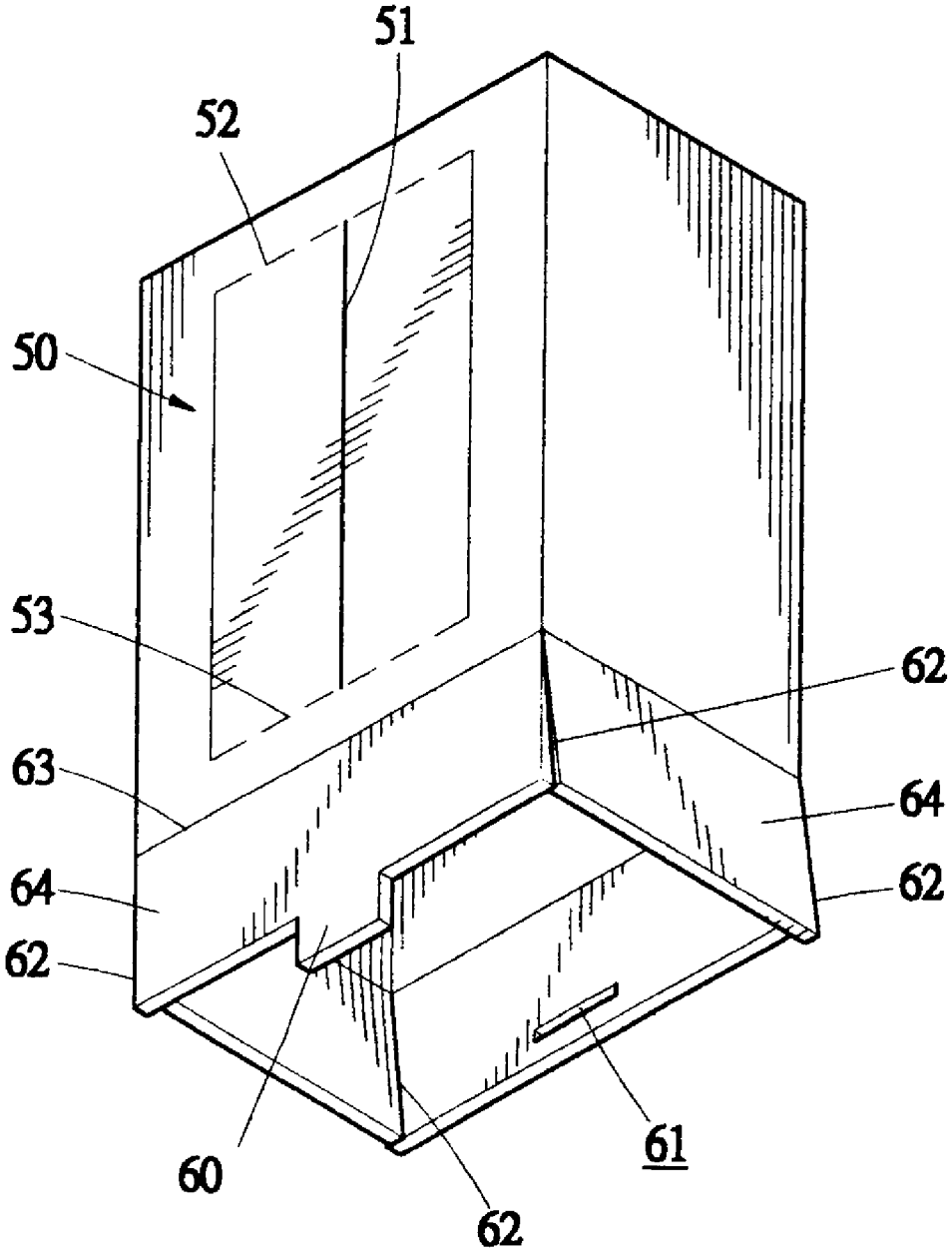
FIG. 7 is a perspective view of a cap portion of the package box in accordance with the second embodiment of the present invention.

The box 10 of the second embodiment is substantially identical to that of the first embodiment, except that four hinge lines 63 are respectively formed on the front, rear and side surfaces of the cap 20 to delimit four panels 64 on the front, rear and side surfaces of the cap 20. Tearing lines 62 are formed between the panels 64, extending along edges of the box 10 that form connection between the panels 64 between the hinge lines 63 and the tear strip 15 whereby the panels 64 are separated from each other after the tear strip 15 is removed and the tearing lines 62 are torn as shown in FIG. 7. The separate panels 64 can be individually folded along the hinge lines 63 into the cap 20 to close the open side of the cap 20 for reinforcing and aesthetic purposes 20 as shown in FIG. 8.

A tab 60 is formed on one of the panels 64 that is the one formed on the front surface in the embodiment illustrated. The tab 60 is formed with a portion of the tear strip 15. In the embodiment illustrated, the tearing line 11 of the tear strip 15 has two ends separated from each other on the front surface which forms a connection between the front panel 64 and the portion of the tear strip 15. Two vertical tearing lines (not labeled) connect between the tearing line 12 and the ends of the tearing line 11 whereby by removing the tear strip 15, the cap 20 is separated from the receptacle 30 along tearing line 12, while leaving a portion of the tear strip 15 with the front panel 64 and thus forming the tab 60.

Figure 8:
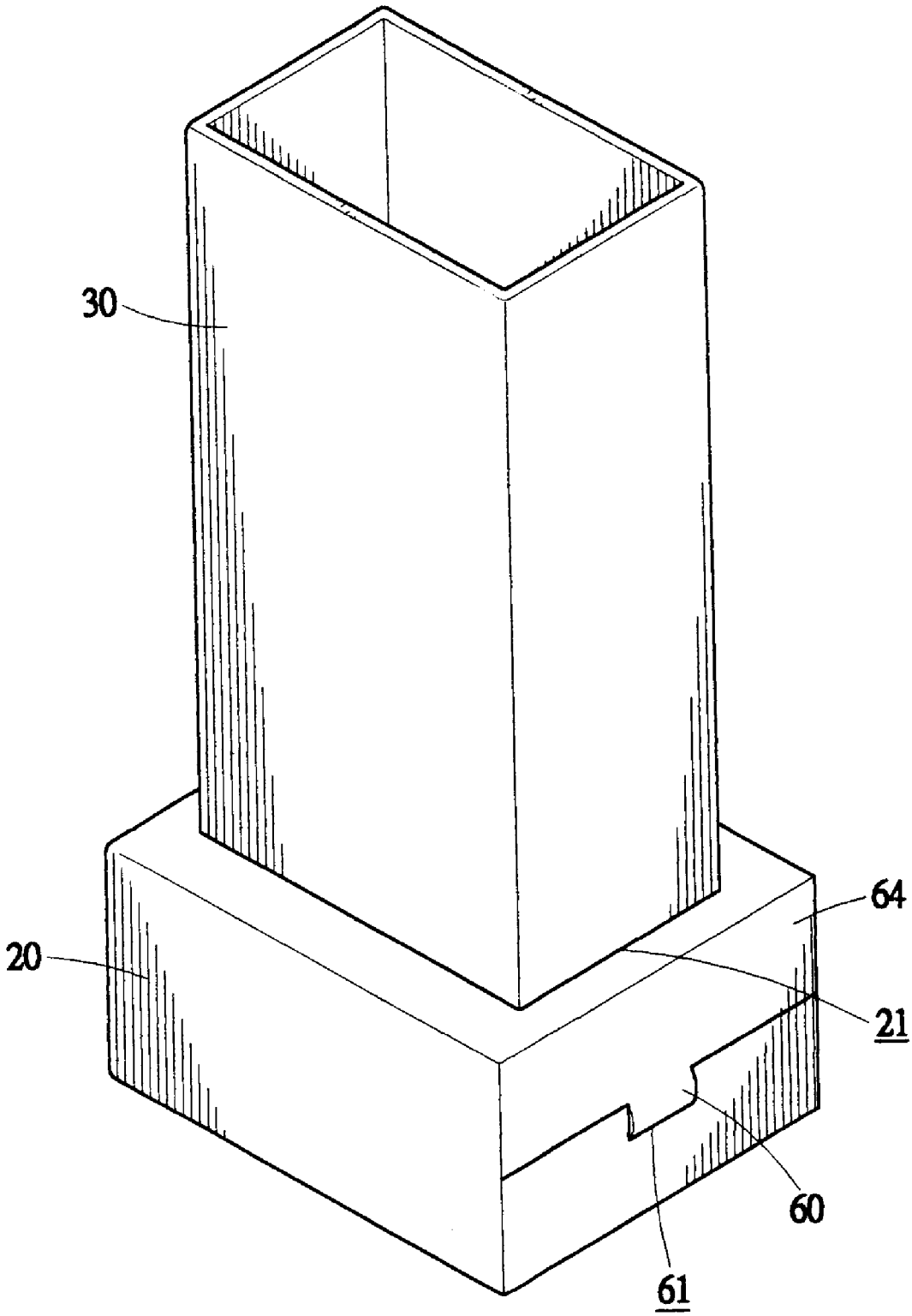
FIG. 8 is a perspective view of an umbrella display bin formed with the package box in accordance with a second embodiment of the present invention.

As shown in FIGS. 7 and 8, a slit 61 is formed on the rear panel 64 that is opposite to the front panel 64 for interferentially receiving the tab 60 so as to secure the panels 64 together for closing the open side of the cap 20 and thus providing a mechanically stable and consumer appealing base for supporting the display bin formed by the receptacle 30.

Similarly, a finger opening 14 is defined in the tear strip 15 adjacent one of the vertical tearing lines connecting the tearing lines 11, 12 by closed tearing lines made on the tear strip 15 for facilitating removal of the tear strip 15.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A package box made of continuous boards to form a parallelepiped container having front, rear, top, bottom and opposite side surfaces, two first tearing lines being formed on the box extending along the front, rear and side surfaces to delimit a tear strip that are removable from the parallelepiped container to separate the package box into a top cap and a bottom receptacle, an opening zone being delimited in the front surface of the cap by two spaced, first hinge lines extending in a first direction and two spaced, second tearing lines extending in a second direction to connect between the first hinge lines, a third tearing line connecting between the second tearing lines and located between the first hinge lines, wherein by tearing off the second and third tearing lines, two flaps are formed on the cap and are selectively folded along the first hinge lines into the cap for forming an opening in the front surface of the cap, the bottom of the receptacle being selectively fit into the opening of the cap to be supported thereby and thus forming an article organizer that is adapted to receive articles therein.

2. The package box as claimed in claim 1, wherein an auxiliary tearing line connects between the first tearing lines of the tear strip.

3. The package box as claimed in claim 2, wherein additional tearing lines are formed in the tearing strip and adjacent the auxiliary tearing line, a portion of the tear strip being closed by the additional tearing lines, wherein the portion of the tear strip that is closed by the additional tearing lines is removable for forming a finger opening adapted to receive a user's finger to facilitate tearing the tear strip.

4. The package box as claimed in claim 1, wherein four second hinge lines are formed on the front, rear and side surfaces of the cap and are spaced from the tear strip whereby when the tear strip is removed, four panels are formed on the cap and wherein fourth tearing lines are formed along connection between adjacent ones of the front, rear and side surfaces, whereby the panels are separated from each other after the fourth tearing lines are torn, the panels being selectively folded along the second hinge lines into the cap for closing an open side of the cap.

5. The package box as claimed in claim 4, wherein a first one of the panels comprises a tab formed on a free edge thereof, a second one of the panels that is opposite the first panel is formed with a slit for interferentially receiving the tab thereby securing the panels together for closing the open side of the cap.

6. The package box as claimed in claim 5, wherein the tab comprises a portion of the tear strip.

7. The package box as claimed in claim 6, wherein the first tearing lines comprise a cap-adjacent line and a receptacle-adjacent line, the cap-adjacent line having ends separate from each other in the first panel, forming a connection between the first panel and the portion of the tear strip, two auxiliary tearing lines formed in the tear strip and connecting between the receptacle-adjacent line and the ends of the cap-adjacent line for delimiting the portion of the tear strip that is connected to the first panel.

8. The package box as claimed in claim 7, wherein additional tearing lines are formed in the tearing strip and adjacent one of the auxiliary tearing lines, a portion of the tear strip being closed by the additional lines, wherein the portion of the tear strip that is closed by the additional tearing lines is removable for forming a finger opening adapted to receive a user's finger to facilitate tearing the tear strip.

* * * * *